US009091516B2

(12) United States Patent
Davies et al.

(10) Patent No.: US 9,091,516 B2
(45) Date of Patent: Jul. 28, 2015

(54) AMMUNITION CARTRIDGE CASE BODIES MADE WITH POLYMERIC NANOCOMPOSITE MATERIAL

(75) Inventors: Jack Davies, Houma, LA (US); Christopher Coco, Salem, NH (US)

(73) Assignee: Nylon Corporation of America, Inc., Manchester, NH (US)

( * ) Notice: Subject to any disclaimer, the term of this patent is extended or adjusted under 35 U.S.C. 154(b) by 5 days.

(21) Appl. No.: 13/877,693

(22) PCT Filed: Sep. 27, 2011

(86) PCT No.: PCT/US2011/053373

§ 371 (c)(1), (2), (4) Date: Apr. 4, 2013

(87) PCT Pub. No.: WO2012/047615

PCT Pub. Date: Apr. 12, 2012

(65) Prior Publication Data

US 2013/0186294 A1 Jul. 25, 2013

Related U.S. Application Data

(60) Provisional application No. 61/390,741, filed on Oct. 7, 2010.

(51) Int. Cl.

| | |
|---|---|
| ***F42B 5/30*** | (2006.01) |
| ***F42B 5/307*** | (2006.01) |
| ***F42B 5/313*** | (2006.01) |

(52) U.S. Cl.

CPC . *F42B 5/30* (2013.01); *F42B 5/307* (2013.01); *F42B 5/313* (2013.01)

(58) Field of Classification Search

CPC ..... F42B 5/30; F42B 5/307; F42B 5/313

USPC ..... 102/464, 465, 466, 467, 468

See application file for complete search history.

(56) References Cited

U.S. PATENT DOCUMENTS

| | | | | |
|---|---|---|---|---|
| 590,428 | A | 9/1897 | Bennett | |
| 3,797,396 | A | 3/1974 | Reed | |
| 4,147,107 | A | 4/1979 | Ringal | |
| 4,478,150 | A | 10/1984 | Sayler et al. | |
| 4,614,157 | A | 9/1986 | Grelle et al. | |
| 5,272,983 | A | 12/1993 | Sippel et al. | |
| 5,563,365 | A | 10/1996 | Dineen et al. | |
| 6,752,084 | B1 | 6/2004 | Husseini et al. | |
| 7,213,519 | B2 | 5/2007 | Wiley et al. | |
| 7,610,858 | B2 * | 11/2009 | Chung | 102/466 |
| 8,240,252 | B2 * | 8/2012 | Maljkovic et al. | 102/466 |
| 8,813,650 | B2 * | 8/2014 | Maljkovic et al. | 102/466 |
| 8,850,985 | B2 * | 10/2014 | Maljkovic et al. | 102/466 |
| 2012/0024183 | A1 | 2/2012 | Klein | |
| 2012/0111219 | A1 | 5/2012 | Burrow | |

* cited by examiner

*Primary Examiner* — James S Bergin

(74) *Attorney, Agent, or Firm* — Renner Kenner Greive Bobak Taylor & Weber

(57) ABSTRACT

The present invention is directed to a three-part ammunition cartridge casing body comprising a head or base portion, a case portion and a cap portion. The cartridge casing body further comprises: the base portion, made of metal or polymeric resin, having a closed end and an open end; a substantially cylindrical case portion, open on both ends, joined to the open end of the base portion and comprising a nanocomposite material of a nanoclay dispersed in a polyamide resin matrix; and a cap portion, made of a nanocomposite material of a nanoclay dispersed in a polyamide resin matrix and further comprising glass fibers, joined to the other end of the case portion, wherein the case portion is more ductile than the cap portion.

9 Claims, 4 Drawing Sheets

AMMUNITION CARTRIDGE CASE BODIES MADE WITH POLYMERIC NANOCOMPOSITE MATERIAL

TECHNICAL FIELD

The present invention relates to a polymeric ammunition cartridge case body. More particularly, the present invention relates to a three-part ammunition cartridge case body wherein at least the cartridge case body is made from nanocomposite polyamide material. Specifically, the present invention relates to a polymeric ammunition cartridge case body wherein the cartridge case portion of the cartridge case body is more ductile that the cap portion of the cartridge case body. Such cartridge case bodies have a failure rate of less than 1% when fired at temperatures ranging from about −54° C. to +52° C. (−65 F to +125 F), and are highly elastic, having a flexural modulus greater than 250 ksi. A method for the manufacture of an ammunition case body employing the nanocomposite polymeric material is also provided.

BACKGROUND

Advances in weapon systems have resulted in soldiers carrying additional gear to enhance combat effectiveness, but at the cost of increased weight. Today, soldiers on combat patrols in Afghanistan typically carry 92 to 105 pounds of mission-essential equipment which includes extra ammunition, chemical protective gear and cold-weather clothing. The overload causes fatigue, heat stress, injury, and performance degradation for soldiers. To ensure that soldiers maintain their readiness, making the load lighter for soldier has become a top priority for the Army.

Despite years of research and development, the Army's weapons and equipment is still too heavy to allow foot soldiers to maneuver safely under fire. One of the heaviest pieces of load for soldiers is the ammunition. Every solider has to carry a lot of ammunition during combat. For example, the weight of 0.50 caliber ammunition is about 60 pounds per box (200 cartridges plus links). It is burdensome for a soldier to move around with heavy ammunition aside from carrying additional gear at the same time. Conventional ammunition cartridges for rifles and machine guns, as well as larger caliber weapons, are usually made from brass, which is heavy, expensive, and potentially hazardous. There exists a need for an affordable, lighter weight replacement for brass ammunition cartridges that can increase mission performance and operational capabilities.

As early as 1960, the U.S. military recognized the benefits of using polymer or polymer composite materials for cartridge case body applications, and since then much research has been carried out by the military and ammunition industry. Previous studies have demonstrated feasibility but have not achieved consistent and reliable ballistic results. Most of the military's and ammunition industry's recent efforts have focused on a two-piece metal (brass) and plastic hybrid cartridge case body design which encountered numerous failures. Testing of a myriad of materials has revealed that the high pressure exhibited by magnum or large caliber rifle ammunition loads at various temperatures gives unacceptable fail rates of the case portion of the cartridge case body of 25% to 75%. Such fail rates are believed due to the high pressure involved during cartridge ignition, such pressures typically being on the order of more than 50,000 psi.

Lightweight polymer cartridge ammunition must meet the reliability and performance standards of existing fielded ammunition and be interchangeable with brass cartridge ammunition in existing weaponry. At the same time, the lightweight polymer cartridge ammunition must be capable of surviving the physical and natural environment to which it will be exposed during the ammunition's intended life cycle. In addition, the polymeric cartridge case bodies should require little to no modification of conventional ammunition manufacturing equipment and methods.

To date, polymeric cartridges have failed to provide satisfactory ammunition with sufficient safety, ballistic and handling characteristics. Most plastic materials, even with a high glass fiber loading, have much lower tensile strength and modulus than brass. Existing polymer/composite cartridge technologies as a result have many shortcomings, such as insufficient ballistic performance, cracks on the case body at its cap, case and/or base, bonding failure of metal-plastic hybrid cases, difficult extraction from the chamber, incompatibility with propellants, insufficient high temperature resistance (burn holes) and chamber constraints produced by thicker case walls.

Other shortcomings include the possibility that portions of the cartridge case body are not flexible or ductile enough for ballistic purposes. Problems associated with the fail rates of many of the ammunition cartridges are believed to be associated with differences between the ductility of cartridge case and the cartridge cap. If not properly manufactured, the cartridge case or cap may explode or otherwise fail upon firing of the ammunition. Weak cartridges having lower modulus pose other problems, such as portions of the cartridge case or cartridge cap breaking off upon firing, or causing the weapon to jam or to be damaged. There is also a danger to the soldier when subsequent rounds are fired or when the casing portions themselves become projectiles.

Prior patents have taught a polyamide resin composition which provides molded articles exhibiting high strength, high modulus, high heat resistance, high toughness, excellent dimensional stability, and high tensile elongation with a small deviation. Examples include nylon-6 polyamide samples derived from ϵ-caprolactam and montmorillonite which may be injection molded. Other patents have taught injection molded polymeric casing components, wherein the casing may include a bullet end component, a middle body component, and a head end component. The head end component may be made of polyamide and may contain reinforcing materials such as nanoclay. The case component is formed from a material that is more ductile than the material from which the base component, but equal to or less than the ductility of the material from which the cap component is formed. The cap component is said to have an elongation at break at 23° C. (73 F) of greater than 50%.

To overcome the above shortcomings, improvements in cartridge case body design and performance polymer materials are needed. A need further exists for at least a portion of the cartridge to be made of a polymeric nanocomposite material with even greater flexural modulus at a wide range of temperatures.

Nanocomposite technology has become increasing more developed over the recent years. Polymer resins containing well-dispersed layered silicate nanoclays are emerging as a class of nanocomposites that provide significantly enhanced mechanical, thermal, dimensional, and barrier properties. In some nanocomposites, for every 1 wt. % addition of the nanoclays, a property may be increased on the order of 10%.

To date, the most common nanoclay being studied is montmorillonite. In the nanocomposite field, nylon 6 has become the most common polymer used. Generally, a nanocomposite material of layered silicate nanoclays dispersed in a nylon 6 matrix has been produced by either in situ polymerization, in which polymerization takes place after mixing monomer or oligomer with organically modified montmorillonite, or melt compounding, which adds an organically modified montmorillonite into a polymer melt.

While the use of nanocomposite materials of nanoclays dispersed in nylon 6 have improved the existing prior art with respect to certain parts of ammunition cartridges, there are other parts of the ammunition cartridge where using such nanocomposite materials have not be successfully employed. For instance, even with nanocomposites of the type above described, the case portion of the ammunition cartridge still has an unacceptable fail rate. Accordingly, a need still exists for a polymeric nanocomposite material that brings the fail rate of the ammunition to less than 1% in the temperature range from −54° C. to +52° C. (−65 F to +125 F).

SUMMARY OF THE INVENTION

One aspect of this invention may be achieved by a three-part ammunition cartridge comprising a head or base portion, a case portion and a cap portion. The head portion may be made of metal or polymeric resin and has a closed end and an open end. The case portion is substantially cylindrical and open at both ends, with one open end joining the case portion to the open end of the base portion. The case portion further comprises a nanocomposite material of a nanoclay dispersed in a polyamide resin matrix. The cap portion may be made of a polymeric resin and is joined to the other end of the case portion. The cap portion may further comprise nanocomposite material of a nanoclay dispersed in a polyamide resin matrix and glass fibers. Notably, the difference in the material composition of the case portion and cap portion is such that the case portion is more ductile than the cap portion.

In another aspect of the invention, the three-part ammunition cartridge casing body includes a polyamide matrix which may be nylon 6, nylon 6/nylon 6,36 copolymer and mixtures thereof. In at least one embodiment of the invention, the polyamide matrix is polyamide 6 (PA6).

In at least one embodiment of the invention, the three-part ammunition cartridge casing body includes a case portion of the ammunition cartridge casing body comprising a nanocomposite material comprising (1) from about 0.1 wt. % to about 10 wt. % of a nanoclay component dispersed in a polyamide resin matrix; (2) from about 1 wt. % to about 40 wt. % of an impact modifier component; and (3) from about 50 wt. % to about 97 wt. % of a nylon copolymer or multipolymer component. In at least one embodiment of the invention, the nanoclay component is montmorillonite clay.

In yet another embodiment of the invention, the three-part ammunition cartridge casing body is further characterized wherein the impact modifier component may be selected from chemically modified polyolefins, maleic anhydride modified ethylene propylene elastomers, maleic anhydride functionalized elastomers, ethylene propylene rubbers, ethylene octane copolymers, ethylene acrylate homopolymers, ethylene acrylate copolymers, ethylene acrylate terpolymers, maleic anhydride grafted ethylene vinyl acetates, ionically crosslinked ethylene methacrylic acid copolymers, and mixtures thereof; wherein the maleic anhydride functionalized elastomer is an ethylene homopolymer, ethylene copolymer, ethylene terpolymer, propylene homopolymer, propylene copolymer, propylene terpolymer, and mixtures thereof; wherein the ethylene acrylate homopolymers, ethylene acrylate copolymers, and ethylene acrylate terpolymers include functionality selected from maleic anhydride, epoxy, and CO groups.

In another embodiment of the invention, the three-part ammunition cartridge casing body is further characterized wherein the nanocomposite material is an in-situ polymerized nanocomposite base resin. In yet another embodiment of the invention, the three-part ammunition cartridge casing body is further characterized wherein the nanocomposite material is a compounded nanocomposite base resin.

Another aspect of the invention includes the three-part ammunition cartridge casing body wherein the cap portion, made of a nanocomposite material of a nanoclay dispersed in a polyamide resin matrix and glass fibers, further comprises 10% glass fibers by weight.

BRIEF DESCRIPTION OF THE DRAWINGS

Any advantages of the present invention will become better understood with regard to the following description, appended claims, and accompanying drawings wherein:

DETAILED DESCRIPTION OF PREFERRED EMBODIMENTS

Figure 1:
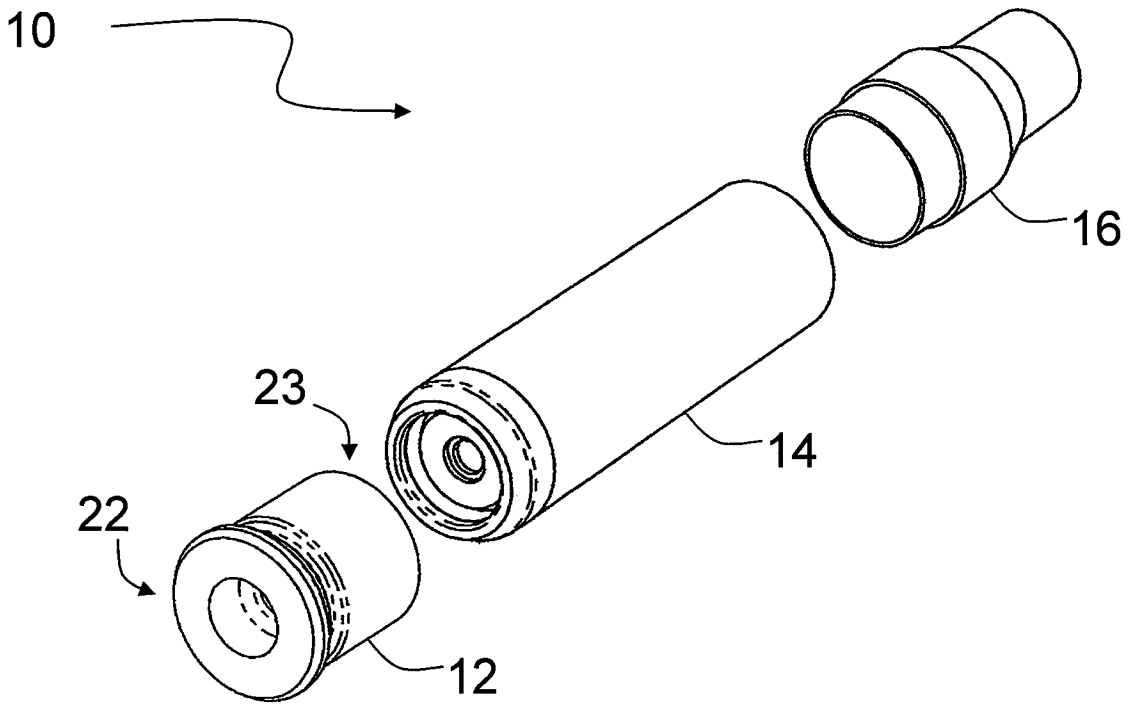
FIG. 1 is an exploded view of the three-part ammunition cartridge including a head insert portion, a middle case portion, and a cap portion constructed according to the concepts of the present invention.

One representative form of an ammunition cartridge of the present invention is shown in an exploded view in FIG. 1 and is generally indicated by the numeral 10. By the term "ammunition cartridge," it is meant the cartridge casing, including the cap, case body, and head insert, but not the projectile for the ammunition. It will be appreciated that such ammunition cartridges can be utilized with high velocity rifles or military weapons.

The ammunition cartridge 10 of the present invention is manufactured as three pieces. The three-part ammunition cartridge 10 includes a head insert portion 12, which may be made of metal or polymer, a middle case portion 14, made of a polymeric nanocomposite, and a cap portion 16, made of a similar polymeric nanocomposite and further including fibers, which may be glass, mineral, or mixtures thereof. The head insert portion, also referred to interchangeably as the base portion, includes a closed end 22 and an open end 23. A primer portion, not shown, fits into the cylindrical opening of the closed end 22 of head or base portion 12.

The cap portion 16 of the ammunition cartridge is open at both ends, but has a smaller diameter at the open end to which the projectile (not shown) may be contained thereto, than the other end, which is joined to the cylindrical case portion 14, also referred to interchangeably as the middle portion.

Figure 2:
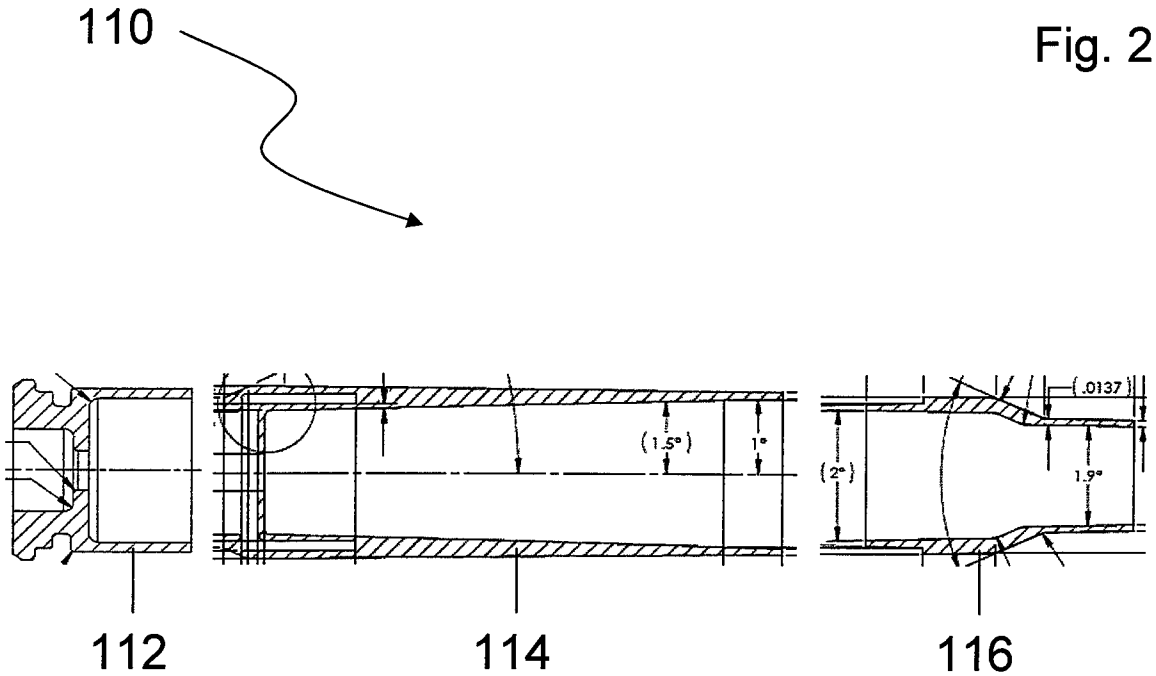
FIG. 2 is cross-sectional view of the three-part ammunition cartridge including a head insert portion, a middle case portion, and a cap portion constructed according to the concepts of the present invention.

As illustrated by FIG. 2, the present invention is generally directed to a cartridge case 110 of the type having a base insert 112 and a case 114 overmolded or otherwise connected thereto. The cartridge case may be described as a bottleneck-style centerfire cartridge case that includes three main components: a base 112, a case 114, and a bottleneck cap 116. The base or head may also be referred to as an insert, which may be metal or polymeric. The case 114 is overmolded to secure over the metal insert base 112 by injection molding processes, as are known in the art. The cap 116 is attached to the case near the forward mouth of the case, and a projectile is installed into the cartridge case at the forward open mouth of the bottleneck cap. The combination of the metal insert base and the overmolded case takes on the following form as shown in FIG. 3, whereby the combination of metal insert base and overmolded case is denoted by the numeral 210.

Figure 3:
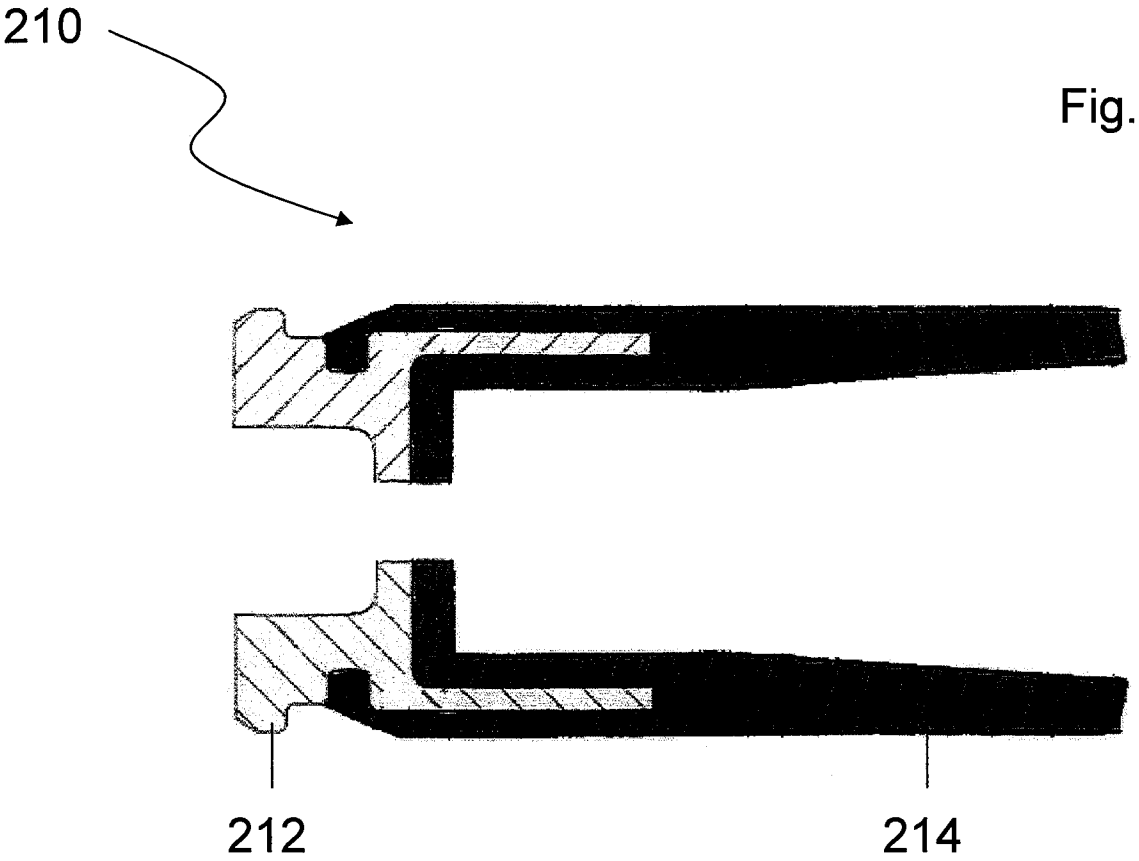
FIG. 3 is a cross-sectional schematic representation of the overmolded portion joining the head insert portion of the three-part ammunition cartridge to the middle case portion according to the concepts of the present invention.

In one or more embodiments, and as illustrated in FIG. 3, the present invention is directed to a base insert for the cartridge case comprising a base end 212 having a lip and a groove proximate the lip and having a primer pocket defined in the base end, and a case 214, also referred to as the middle case portion, having a base wall and a cylindrical wall extending there from, said base wall and cylindrical wall defining a powder fill pocket. The base wall has a flash hole disposed therein and an inner surface facing the powder fill pocket. The cylindrical wall has an inner surface intersecting with the inner surface of the base wall and an outer surface defining the outer circumference of the base insert. The intersection of the inner surface of the base wall and the inner surface of the cylindrical wall is curved, while the outer surface of the insert end is not curved. The cartridge casing, for example, as described in co-pending U.S. Appl. No. 60/381,609, incorporated herein by reference, is suitable for use in the present invention.

Further illustrated by FIG. 3, the base has a body that is divided axially at a web portion into two cup portions defined by annular structure portions: a first annular structure portion extends from the web forward in the direction of the position of the projectile; and a second annular structure portion extends from the web portion rearward in a direction away from the position of the projectile. The first annular structure portion extends forward to fit within a portion of the case, and the second annular structure defines a primer holding chamber, a rim and a groove. The combined base 212 and case 214 define an extraction groove.

The case 214 has a body that is formed by injection molding. During the molding process, a base is situated in a mold and plastic material is injected into the mold and flows over portions of the base, including the cup portion defined by the first annular structure portion, the case forming an outer annular portion and an inner annular portion. The outer annular portion is radially outside the first annular structure portion of the base, and the inner annular portion is radially inside the first annular structure portion of the base. The outer annular portion and inner annular portion of the case extend only along a portion of the base, and neither reaches the rim. A lip extends radially-inwardly from the outer annular portion near the end of the case and is received within the groove defined in the second annular structure portion of the base. A flash hole extends through the web of the base and the case at the radial center of the combined base and case. A propellant chamber is defined within the case, and the flash hole connects the primer holding chamber in the base with the propellant chamber in the case.

I. MATERIALS

The need for lightweight casings exhibiting extremely low fail rates is met by the present invention. By using an innovative polymer casing composition, the present invention provides a composition for manufacture of lightweight polymeric cased cartridges, meeting military performance requirements, wherein the cartridge casings exhibit fail rates of less than 1% in the temperature range from −54° C. to +52° C. (−65 F to +125 F).

Materials useful in the manufacture of the three-part ammunition cartridge of the present invention include polymeric materials. Generally, polymeric materials are useful in a wide range of materials applications: sporting goods (e.g hockey skate blade holders, lacrosse heads, ski and snowboard bindings, ski and in-line skate boots); industrial applications (e.g. fan blades, power tool housings); aerospace & automotive applications (e.g. small engines); lightweight clips and fasteners; replacement for glass filled parts; and defense applications including in ammunition casings. Due to high pressures involved during cartridge ignition (>50,000 psi) as exhibited by magnum (or large caliber rifle), materials able to withstand such high pressures are needed, particularly those that overcome typically high fail rates. The present invention provides engineered materials to provide ammunition casings with high elasticity and high flexural modulus.

The head or base portion of the three-part ammunition cartridge casing may be metal or polymeric. Examples of suitable metals include stainless steel, plain or hardened steel, and brass while examples of suitable polymers include filled or unfilled nylon, and may also include the polymeric material of the invention as described below and used in at least the middle case portion of the cartridge casing. Preferably hardened steel is useful in the present invention.

Whereas the head or base portion of the cartridge casing may be metal or polymer, the case portion and the cap portion of the cartridge casing are preferably made of polymeric materials according to the invention. The cap portion may further include fibers, which may be glass, mineral, or mixtures thereof, as will be discussed further below.

The impact modified polymeric composition of the present invention yields higher flexural modulus and higher tensile strength than previously known nanocomposites. This is achieved by including an impact modifying component into the composition which also includes a nylon copolymer/multipolymer component and a nano component. The composition, which is employed in at least one of the three-part ammunition cartridge casing body, and in preferred embodiments is useful in the case portion, also known as the middle portion, is discussed below.

A. Nylon and Nylon Copolymer/Multipolymer Component

Nylon is the generic name for a family of polyamide polymers characterized by the presence of an amine (—NH) group and an acid (—C═O) group within the monomer. The most basic chemical form of nylon is

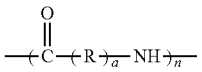

where R is any saturated or unsaturated, branched or unbranched, substituted or unsubstituted, aliphatic, cyclic or aromatic hydrocarbon and a and n separately equal any positive integer. This is considered an AB type nylon, the A referring to the acid and the B referring to the amine. Where a=6, caprolactam is produced as the monomer, nylon 6 being the polymer thereof. Other well known nylons of the AB type include nylon 4, 9, 11 and 12, wherein the numeral sets forth the number of primary carbons within the structure.

In addition to the above nylons, other nylons are characterized by the use of diacids and diamines to produce a polymer having the general chemical structure

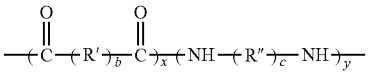

where R' and R" may be the same or different and, like R above, are any saturated or unsaturated, branched or unbranched, substituted or unsubstituted, aliphatic, cyclic or aromatic hydrocarbon, b and c are separately any positive integer, and x and y equals molar percent 1 to 99%. These AABB type nylons, i.e., those polyamides characterized by diamine and diacid monomers, are well known in the art. The most common of these types of nylons is nylon 6,6 (hexamethylenediammonium adipate) which includes a 6 carbon diamine and a 6 carbon diacid monomer. Other such nylons include, inter alia, nylon 6,9, nylon 6,10, nylon 612, nylon 613, and nylon 6,14.

Polymers of the AABB type having high molecular weights can be derived as condensation products from the reaction of fatty dibasic acids (e.g., $C_{18}$, $C_{19}$, $C_{21}$, and $C_{36}$) and di- and polyfunctional amines. For purposes of this disclosure, the term "fatty dibasic acid" will refer to any of the high molecular weight diacids of at least 15 primary carbon units. Examples include pentadecanedioic acid, commonly known to have 15 carbon units ($C_{15}$), and carboxystearic acid, commonly known to have 19 carbon units ($C_{19}$). The term "dimer acids" as used throughout this disclosure "will generally refer to those dicarboxylic acids formed by the reaction of two or more $C_{18}$ fatty acids, but may, for time to time, be employed to refer to all or any of the fatty acids in general. Commercial dimer acid products are generally known to be mixtures of mostly $C_{36}$ dibasic acids containing some trimer ($C_{54}$), higher oligomers and small amounts of monomer ($C_{18}$) acids. A more complete description of fatty acids and dimer acids as they relate to the production of polyamides can be found in "Polyamides from Fatty Acids," *Encyclopedia of Polymers*. Vol. 11, pp. 476-89 (1988), which is incorporated herein by reference. Those skilled in the art will readily appreciate that a high molecular diacid, such $C_{18}$, can be changed into a high molecular diamine through known chemical reactions. Generally it is known in the art that nylon 6,36 and other fatty acid/diamine based polymers are not soluble in typical solvents such as water, these polymers must be polymerized with chain terminators and low molecular weight acids to increase solubility.

In one or more embodiments, the polymer of the invention includes a nanocomposite nylon material. Such materials are produced by the incorporation of nanoclays into a polyamide matrix. Two general classes of nano-morphology are intercalated and delaminated, wherein the silicate layers in a delaminated structure may not be as well-ordered as in an intercalated structure. Both intercalated and delaminated structures may coexist as a mixed nano-morphology in the polymer matrix.

Preferred polyamides for use in the present invention include: Nylon 6, also known as Polyamide 6 or PA6, and Nylon 6 reinforced with nanoclay as will be discussed in more detail below. Nylon-6 is made from a single monomer called caprolactam, also known as 6-amino-caproic acid. Polymers, such as PA12, could also be used. In at least one embodiment of the present invention, the polymeric composition includes nylon copolymers or multipolymers; non-limiting examples include NYCOA 6/6,36 or NYCOA 2012 copolymer nylon.

In at least one embodiment of the present invention, the polymer composition includes at least about 40% nylon polymer or multipolymer component. In other embodiments of the present invention the polymer composition includes at least about 45 wt %, or in other embodiments at least about 48%, in other embodiments at least about 49 wt %, in other embodiments at least about 50 wt %, in other embodiments at least about 51 wt %, in other embodiments at least about 52 wt %, in other embodiments at least about 53 wt %, in other embodiments at least about 54 wt %, in other embodiments at least about 55 wt %, in other embodiments at least about 56 wt %, in other embodiments at least about 57 wt %, in other embodiments at least about 58 wt %, in other embodiments at least about 59 wt %, in other embodiments at least about 60 wt %, in other embodiments at least about 61 wt %, in other embodiments at least about 62 wt %, and in yet other embodiments at least about 65 wt % nylon polymer or multipolymer component. In at least one embodiment of the present invention, the polymer composition includes less than about 99% nylon polymer or multipolymer component. In other embodiments of the present invention the polymer composition includes less than about 98 wt %, in other embodiments less than about 95 wt %, in other embodiments less than about 90 wt %, in other embodiments less than about 80 wt %, in other embodiments less than about 70 wt %, in other embodiments less than about 65 wt %, in other embodiments less than about 64 wt %, in other embodiments less than about 63 wt %, in other embodiments less than about 62 wt %, in other embodiments less than about 61 wt % nylon polymer or multipolymer component. The multipolymer may be mixed into the polymeric composition in a second extrusion step.

The nanocomposite nylon material of the invention may include Nylon 6 clay hybrid (NCH) as developed by Toyota Central Research and Development Laboratories, Inc. (TCRDL). Such NCH materials, achieved by heat induced polymerization rather than by anionic polymerization, have a clay content ranging from about 2 to 8 wt %. One non-limiting example of NCH is the 5 wt % (NCH5) Nylon 6/layered silicate in-situ polymerized polymer/layered silicate nanocomposite (PLSN) wherein montmorillonite is the silicate. Such 5 wt % (NCH5) Nylon 6/layered silicate in-situ polymerized polymer/layered silicate nanocomposite (PLSN) is commercially available from Ube Industries, Ltd. (Japan). The ring-opening polymerization of ϵ-caprolactam initiated by pendant carboxylic acids on the surface of the modified montmorillonite results in approximately 50% of the nylon 6 chains tethered to the surface of the montmorillonite via ionic interaction of the primary ammonium cation, as was reported by A. Usuki et al., J. Mater. Res., 8, 117 (1993), which is incorporated herein by reference.

One non-limiting example of a polyamide matrix reinforced with nanoclay is NYCOA 9070. Another non-limiting example of a polyamide matrix reinforced with nanoclay and further including, a multipolymer is NYCOA 8330. By mixing in a copolymer, the properties and behavior of the nanocomposite material is improved by increasing elongation, impact, and flexibility. For example, as the cartridge round is fired, the casing can form to the profile of the rifle chamber and, subsequently, relax back to its original form for extraction.

B. Nanoclay Component

Nanoclays are surface modified montmorillonite clays that are utilized to make a nanocomposite. Nanoclay dimensions are in the range of 200-500 nm ($10^{-9}$ meters). The nano-sized clay particles are composed of montmorillonite minerals, a layered clay mineral having aluminosilicate layers on the order of about one nanometer in thickness. The nanoclay may act as a barrier material which dramatically prevents vapors and liquids from penetrating through, for example, nanoSEAL™ resin.

Figure 4:
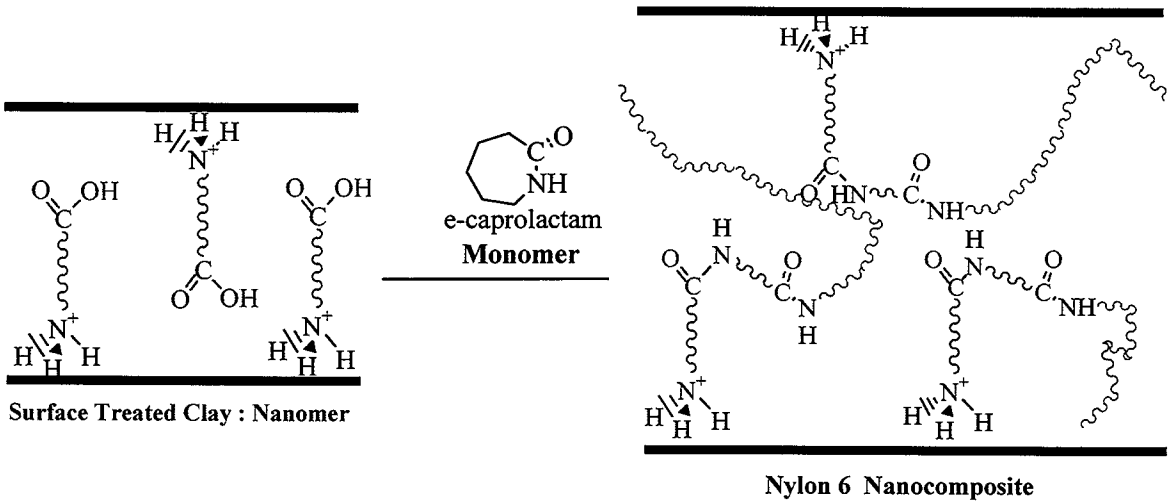
FIG. 4 is a representative diagram of a nanoclay reaction with a caprolactam monomer via in-situ batch polymerization technique to form a nylon 6 nanocomposite used in the present invention.

At least one embodiment of the present invention relates to nanocomposites, which may be defined as a class of plastics containing a highly refined form of nanoclay that is uniformly dispersed in a polymer matrix. The clays can be incorporated into the polymer matrix by compounding methods that are well known through extruder technology from loads of 0.1 to 10% by weight or through in situ polymerization where the clay is introduced during prepolymerization at the monomeric phase of the reaction. The nanoclay may be incorporated into the monomer via in-situ batch polymerization techniques according to, for example, FIG. 4; or the nano component may be a compounded nanocomoposite base resin.

Nanoclays are surface modified montmorillonite clays, or master batches containing modified clays, that are utilized to make a nanocomposite. Nanoclay dimensions are in the range of 200-500 nm (10-9 meters). The nanoclay is fully exfoliated by in-situ batch polymerization and tethers to the PA-6 polymer chain to yield completely exfoliated clay platelets. The terms delaminated and exfoliated are used interchangeably. The resulting nanocomposites result in higher stiffness materials offering the designer an option of producing thinner walls and lighter products. Also, benefits of the inventive material include improved heat distortion temperature and higher retention of mechanical properties under humid conditions. Such nanocomposites are inherently fire retardant.

In at least one embodiment of the present invention, the polymer composition includes a nanoclay component of at least about 0.1 wt % by weight nanoclay in polymer material, in other embodiments at least about 0.5 wt %, in other embodiments at least about 1 wt %, in other embodiments at least about 2 wt %, in other embodiments at least about 3 wt %, in other embodiments at least about 4 wt %, in other embodiments at least about 5 wt %, in other embodiments at least about 6 wt %, in other embodiments at least about 7 wt %, in other embodiments at least about 8 wt %, in other embodiments at least about 9 wt %, and in other embodiments at least about 10 wt %. The polymer material may be a nylon or polyamide material, such as nylon 6 or polyamide 6 (PA6). One non-limiting example of a polyamide matrix reinforced with nanoclay is NYCOA 9070. Another non-limiting example of a polymer/layered silicate nancomposite incorporating Nylon 6 as the polymer is 5 wt % (NCH5) Nylon 6/layered silicate in-situ polymerized polymer/layered silicate nanocomposite (PLSN), commercially available from Ube Industries, Ltd. (Japan).

C. Impact Modifier Component

In at least one embodiment of the present invention, the polymer composition includes an impact modifier component. The impact modifier component may be chemically modified polyolefins, maleic anhydride modified ethylene propylene elastomers such as Royaltuf or Exxelor; maleic anhydride functionalized elastomers consisting of ethylene and/or propylene homopolymers, copolymers, or terpolymers (Exxelor, Fusabond); ethylene propylene rubbers; ethylene-octene copolymer (Fusabond); ethylene acrylate homopolymer, copolymer, terpolymer that is maleic anhydride or epoxy or containing CO functionality (such as Fusabond/Elvaloy); maleic anhydride grafted ethylene vinyl acetate (EVA) (Fusabond); and ionically crosslinked ethylene methacrylic acid copolymer (Surlyn). Other materials suitable as impact modifier component in the present invention include: Fusabond® P Series (functionalized polypropylenes), Fusabond® N Series (nylon modifiers), Fusabond® E Series (functionalized ethylene-based modifiers), Fusabond® C Series (functionalized ethylene vinyl acetate (EVA) based modifiers), and Fusabond® A Series (functionalized ethylene terpolymers).

In at least one embodiment of the present invention, the polymer composition includes at least about 1% impact modifier component. In other embodiments of the present invention the polymer composition includes at least about 5 wt %, or in other embodiments at least about 10%, in other embodiments at least about 15 wt %, in other embodiments at least about 20 wt %, in other embodiments at least about 22 wt %, in other embodiments at least about 23 wt %, in other embodiments at least about 24 wt %, in other embodiments at least about 25 wt %, in other embodiments at least about 26 wt %, in other embodiments at least about 27 wt %, in other embodiments at least about 28 wt %, in other embodiments at least about 29 wt %, in other embodiments at least about 30 wt %, in other embodiments at least about 35 wt %, and in yet other embodiments at least about 40 wt % impact modifier component.

D. Optional Additives

Optional additives may be added to the polymer to improve properties or aesthetics as is known in the art. These additives may include antioxidants such as CYANOX HS; elastomer and processing aids and release agents such as calcium stearate (Struktol, Stow, OHIO), and other additives such as Chimmasorb 944. In at least one embodiment of the present invention, the polymer of the inventive composition includes at least about 0.4 wt % and less than about 3 wt % optional additives. For the cap portion of the three-part ammunition cartridge casing body, a similarly prepared polymeric material such as described for the middle case portion may be utilized with the further addition of up to 20% by weight glass fiber, mineral fiber, or glass fiber and mineral filled to increase stiffness. In other embodiments, at least 5% by weight and less than 15% by weight glass fiber is added. In other embodiments, at least 7% by weight and less than 13% by weight glass fiber is added. In other embodiments, at least 9% by weight and less than 11% by weight glass fiber is added. In yet other embodiments, about 10% by weight glass fiber is added. One non-limiting example of a cap portion composition is NYCOA 8330 G10.

II. METHODS

An ammunition cartridge is provided having: 1) an injection molded substantially cylindrical polymeric cartridge casing body with an open projectile-end and an open end opposing the projectile-end, in which the cartridge casing has: (A) a substantially cylindrical injection molded polymeric cap component with opposing first and second ends, the first end of which is the projectile-end of the casing body and the second end has a male or female coupling element; and (B) a cylindrical polymeric case component with opposing first and second ends, wherein the first end has a coupling element that is a mate for the cap coupling element and thereby joins the first end of the case component to the second end of the cap component, and the second end of the case component is the end of the casing body opposite the projectile end and has a male or female coupling element; and (2) a cylindrical cartridge casing base component having an essentially closed base end with a primer hole opposite an open end having a coupling element that is a mate for the coupling element on the second end of the case component and thereby joins the second end of the case component to the open end of the of the casing base component; wherein the case component is formed from a material that is more ductile than the material from which the base component is formed and also more ductile than the material from which the cap component is formed. Advantageously, the case portion is the most ductile component in the cartridge casing body of the present invention.

The case component is made from materials as described previously including (1) an impact modifier component; (2) a nanoclay component; (3) a nylon polymer or multipolymer component; and (4) optional additives. The term multipolymer is meant to include also copolymers. The cap is made from polymeric materials selected from the group polymer, fiber reinforced polymer composite, or nanocomposites. Injection molding of the polymer and polymer composite components maximizes the interior volume by permitting the formation of narrow-walled components. Furthermore, the cap can be the case composition. The same or different polymers can be used in the construction of the two components. The cap may further include glass fibers.

The case component can have a male coupling element on both ends, in which case both the second end of the cap component and the open end of the casing base component will have female coupling elements. The case component can also have a female coupling element on both ends, in which case both the second end of the cap component and the open end of the casing base component will have male coupling elements. The case component can also have a male coupling element on one end and a female coupling element on the other end and the second end of the cap component and the open end of the casing base component will have the mate for the coupling element on the end of the case component to which it is joined. The tips of the coupling elements may be tapered on both ends to facilitate insertion.

In one embodiment the first end of the case component has a female coupling element and the second end of the cap component has a male coupling element, wherein the male coupling element of the cap component is dimensioned to achieve an interference fit within and engage the female coupling element of the case component. The interference fit between the case component and the cap component can be accomplished when the inner diameter (ID) of the female coupling element is equal or smaller than the outer diameter (OD) of the male coupling element. In the same embodiment, the second end of the case component has a male coupling element, and the open end of the casing base component has a female coupling element, wherein the male coupling element of the case component is similarly dimensioned to achieve an interference fit or simply fit within and engage the female coupling element of the head end component.

The base component is made of high strength polymer, polymer composite, ceramic or metal. Preferably the base component is made of metal, more preferably aluminum, steel or brass. As previously described, hardened steel is suitable in the present invention.

The base and case components may be joined by adhesive bonding, interference fit, snap-fit joint or an injection molded-in joint. The base and case components may be joined by overmolding as in co-pending U.S. Appl. No. 61/381,609. The case and cap components may be joined by adhesive bonding, solvent welding, spin welding, vibration welding, ultrasonic welding or laser welding, or by overmolding.

The cap component has a neck with an inner diameter preferably tapering to the projectile end, within which the projectile is seated and secured. The inner diameter of the neck is dimensioned to achieve an interference fit with the circumference of the projectile. The projectile may be held in place in the casing neck by interference fit, crimping or mechanical fastening and through chemical bonding.

The projectile end of the casing neck may also have an internal recess adapted to receive and hold in place the projectile. In an alternate embodiment, the cap component may be made of a ductile polymer and is molded with a plurality of internal structures for supporting the projectile and holding it in place.

Polymers suitable for molding of the case component have one or more of the following properties: fail rates of less than 1% in the temperature range from −54° C. to +52° C. (−65 F to +125 F); tensile strength greater than 4,000 psi and flexural modulus greater than 200 ksi (kilo-psi or kilo pounds per square inch).

The case component can be mated to the base component either by injection molding the case component onto the base component, overmolding as previously described, or by snap-fitting the two components together. The cap component can also be snap-fit or interference fit to the case component. The individual components are otherwise formed by essentially conventional means and may be welded or bonded together by conventional techniques for joining polymeric materials to the same or different polymer, ceramic or metal.

These materials can then be molded through existing Injection Molding technologies in the required caliber bullet. The cases can then be "loaded" according to conventional ammunition manufacturing means to produce live rounds of bullets.

Once assembled, the cartridge casing can be loaded with propellant and assembled with a projectile. This can be performed in-line, or the cartridge casings can be transported to a different location to be filled with propellant and joined to a projectile, and without significant modification of existing production lines for filling brass cartridge casings and mounting projectiles thereon.

III. INDUSTRIAL APPLICABILITY

The polymer of the invention may also be used in materials applications such as sporting goods (e.g hockey skate blade holders, lacrosse heads, ski and snowboard bindings, ski and in-line skate boots); industrial application (e.g. fan blades, power tool housings); aerospace & automotive applications (e.g. small engines); lightweight clips and fasteners; replacement for glass filled parts; and defense applications including in ammunition casings. Such polymers provide weight reduction versus glass filled parts whereby at least a 6% reduction in weight can be achieved with the same performance, flame retardancy (with about 20% reduction in flame retardant agents necessary), reduction of peak heat release rate, significant reduction in dripping of molten resin, eliminate PTFE as an anti dripping agent, recycle capability and environmental benefits. The nanocomposite polymer may be made to suit various needs and can be tailored to specification in UV, HS, and custom color formulations. The materials may be injection molded, extruded, or blow molded, for example.

Various modifications and alterations that do not depart from the scope and spirit of this invention will become apparent to those skilled in the art. This invention is not to be duly limited to the illustrative embodiments set forth herein.

EXAMPLES

TABLE 1

Formulation of Impact Modified Nanocomposite Polyamide Material

| Component | % by weight |
|---|---|
| 9070 | 57 |
| Fusabond 498D | 27 |
| 2012 | 14.6 |
| Cyanox HS | 0.5 |
| Calcium Stearate | 0.4 |
| Chimmasorb 944 | 0.5 |

A polymer composition according to invention and detailed in Table 1 was made. The 9070 is a nanocomposite component in which 7 wt % nanoclay component was incorporated into PA6 by method of in situ batch polymerization. Fusabond 498D was added as impact modifier component. Nylon multipolymer component 2012 (NYCOA 6/6,36) was included along with additives Cyanox HS, Calcium Stearate, and Chimmasorb 944. The impact modified composition of the invention may also be known as NYCOA 8330R.

The polymer composition according to the invention yielded increases flexural modulus and tensile strength as compared with similar materials formulated with and without impact modifier, as shown on Table II. Inventive sample 8330R shows improved flexural modulus and tensile strength over polymer without impact modification and also over comparative sample 2326, an impact modified grade of PA6 with the same loading of impact modifier as 8330R.

TABLE II

| Polymeric Material | Flex Mod (ksi) | Percentage Increase | Tensile Strength (psi) | Percentage Increase |
|---|---|---|---|---|
| No impact modification | 220 | — | 7,000 | — |
| Inventive Sample 8330R | 254 | 15.5% | 7,540 | 8% |
| Comparative Sample 2326 | 218 | −1% | 6,500 | −7% |

What is claimed is:

1. A three-part ammunition cartridge casing body comprising:

a base portion, made of metal or polymeric resin, having a closed end and an open end;

a substantially cylindrical case portion, open on both ends, joined to the open end of the base portion and comprising a nanocomposite material of a nanoclay dispersed in a polyamide resin matrix; and a cap portion, made of a nanocomposite material of a nanoclay dispersed in a polyamide resin matrix and glass fibers, joined to the other end of the case portion, wherein the case portion is materially different from and more ductile than the cap portion.

2. The three-part ammunition cartridge casing body of claim 1, wherein the polyamide matrix includes nylon 6, nylon 6/nylon 6,36 copolymer and mixtures thereof.

3. The three-part ammunition cartridge casing body of claim 1, wherein the case portion of the ammunition cartridge casing body comprises a nanocomposite material comprising (1) from about 0.1 wt. % to about 10 wt. % of a nanoclay component dispersed in a polyamide resin matrix; (2) from about 1 wt. % to about 40 wt. % of an impact modifier component; and (3) from about 50 wt. % to about 97 wt. % of a nylon copolymer or multipolymer component.

4. The three-part ammunition cartridge casing body of claim 3 wherein the impact modifier component may be selected from chemically modified polyolefins, maleic anhydride modified ethylene propylene elastomers, maleic anhydride functionalized elastomers, ethylene propylene rubbers, ethylene octane copolymers, ethylene acrylate homopolymers, ethylene acrylate copolymers, ethylene acrylate terpolymers, maleic anhydride grafted ethylene vinyl acetates, ionically crosslinked ethylene methacrylic acid copolymers, and mixtures thereof;

wherein the maleic anhydride functionalized elastomer is an ethylene homopolymer, ethylene copolymer, ethylene terpolymer, propylene homopolymer, propylene copolymer, propylene terpolymer, and mixtures thereof;

wherein the ethylene acrylate homopolymers, ethylene acrylate copolymers, and ethylene acrylate terpolymers include functionality selected from maleic anhydride, epoxy, and CO groups.

5. The three-part ammunition cartridge casing body of claim 3, wherein the nanoclay component is montmorillonite clay.

6. The three-part ammunition cartridge casing body of claim 1 wherein the nanocomposite material is an in-situ polymerized nanocomposite base resin.

7. The three-part ammunition cartridge casing body of claim 1 wherein the nanocomposite material is a compounded nanocomposite base resin.

8. The three-part ammunition cartridge casing body of claim 1 wherein the polyamide matrix is polyamide 6.

9. The three-part ammunition cartridge casing body of claim 1 wherein the cap portion, made of a nanocomposite material of a nanoclay dispersed in a polyamide resin matrix and glass fibers, includes 10% glass fibers by weight.

* * * * *